US005226023A

United States Patent [19]

Grimm

[11] Patent Number: 5,226,023

[45] Date of Patent: Jul. 6, 1993

[54] TIMEPIECE MOVEMENT EXHIBITING SPECIAL DECORATIVE EFFECTS AND TIMEPIECE PROVIDED WITH SUCH A MOVEMENT

[75] Inventor: Maurice Grimm, Bole, Switzerland

[73] Assignee: ETA SA Fabriques d'Ebauches, Switzerland

[21] Appl. No.: 896,997

[22] Filed: Jun. 11, 1992

[30] Foreign Application Priority Data

Jun. 27, 1991 [CH] Switzerland ..... 01 898/91-6

[51] Int. Cl.[5] ..... G04B 19/00; G04B 19/06

[52] U.S. Cl. ..... 368/223; 368/229; 368/228; 368/281

[58] Field of Search ..... 368/223-249, 368/281-282

[56] References Cited

U.S. PATENT DOCUMENTS 4,995,021 2/1991 Sullivan ..... 368/233
5,007,034 4/1991 Shimozono ..... 368/233

FOREIGN PATENT DOCUMENTS 8130242 1/1982 Fed. Rep. of Germany .
24680 11/1901 Switzerland .
30479 4/1904 Switzerland .
665078 4/1988 Switzerland .
676074 12/1991 Switzerland .

OTHER PUBLICATIONS

International Publication No. WO 88/02507 (PCT/DE87/00434) filed 23 Sep. 1987.
Swiss Search Report.

*Primary Examiner*—Bernard Roskoski
*Attorney, Agent, or Firm*—Pollock, Vande Sande & Priddy

[57] ABSTRACT

The invention concerns a timepiece movement having a baseplate (20), a motor (22), an oscillating system (24), driving elements (26, 27) intended to drive indicating elements (16, 18), a gear train (28) having at least one wheel coupling the driving elements (26, 27) to the motor (22), the motion of the gear train being regulated by the oscillating system (24), the timepiece movement being characterized in that it further includes a support element (50) for at least one of the elements other than the baseplate constituting the movement, the support element (50) being driven in rotation in the vicinity of the edge of the baseplate by a wheel (48) of the gear train.

14 Claims, 3 Drawing Sheets

TIMEPIECE MOVEMENT EXHIBITING SPECIAL DECORATIVE EFFECTS AND TIMEPIECE PROVIDED WITH SUCH A MOVEMENT

The present invention concerns a timepiece movement which enables giving an original and attractive decorative aspect to the timepiece which it is intended to equip and more particularly, a timepiece movement in which such aspect is obtained through the animation of normally fixed elements constituting the movement. The invention also concerns a timepiece equipped with such a movement.

BACKGROUND OF THE INVENTION

To bestow to timepieces an attractive and original aspect has been a constant care among watchmakers ever since horology came into existence.

Such care has been expressed over the course of epochs and in accordance with fashion through numerous variations in the choice of materials, forms and colours to fashion the various outer elements of timepieces or further in special arrangements of such elements relative to one another.

One has, for instance, in patent CH-30479, crafted a watch comprising a movement the balance wheel of which, normally invisible from the exterior of the watch, is located on the dial side and appears through an opening arranged in such latter at 6 o'clock in order to give the watch an unusual aspect.

In another type of watch called skeleton watch it has been conceived to render the entire movement visible after having provided the baseplate and the bridge of this latter with open work in order to render visible the parts normally hidden under these elements and thus to make apparent the complexity with which such parts are interlocked.

It has also been proposed in patent CH-665 078 to have a watch exhibiting special effects which consist in having periodically appear an image determined with the help of the indicating parts.

The U.S. Pat. No. 4,734,895 describes a watch comprising a support arm for a decorative element extending radially from the central axis of the movement and mounted for rotation about such axis in a manner such that the decorative element such as a diamond may freely turn in a zone located at the periphery of the dial.

The applicant proposes to open up a new trail in order to add unusual attraction and originality to time indicating functions in a timepiece.

SUMMARY OF THE INVENTION

To this effect, the object of the invention is a timepiece movement comprising a baseplate, motor means, an oscillating system, driving means intended to drive indicating elements and a gear train comprising at least one wheel coupling the driving means to the motor means, the movement of the gear train being regulated by means of the oscillating system.

In conformity with the invention, the movement furthermore comprises a support element for at least one of the parts making up the movement excepting baseplate, the support element being driven in rotation in the neighbourhood of the edge of the baseplate by a wheel of the gear train.

Thanks to these characteristics, there is obtained animation of an element making up the movement which is normally fixed above the baseplate, such as to confer on the timepiece in which it is intended to be installed, a particularly original aspect without such characteristics having a damaging influence on the operating precision of the movement.

According to a preferred embodiment of the invention, the movement is a mechanical movement and the support element bears the oscillating system, such latter comprising a regulating element and an escapement.

Utilization of a mechanical movement enables conferring to already moving elements, in the case at hand the oscillating system, a supplementary mobility of a type such that the animation effect of such element is accentuated.

According to an advantageous characteristic of the invention, the support element has a generally planar form and comprises a central cavity provided on its edge with teeth through which it is driven.

Other characteristics and advantages will appear upon reading of the description which follows of an embodiment of the invention, given by way of illustration and not intended to be limiting, in connection with the attached drawings.

DESCRIPTION OF THE PREFERRED EMBODIMENT

Figure 1:
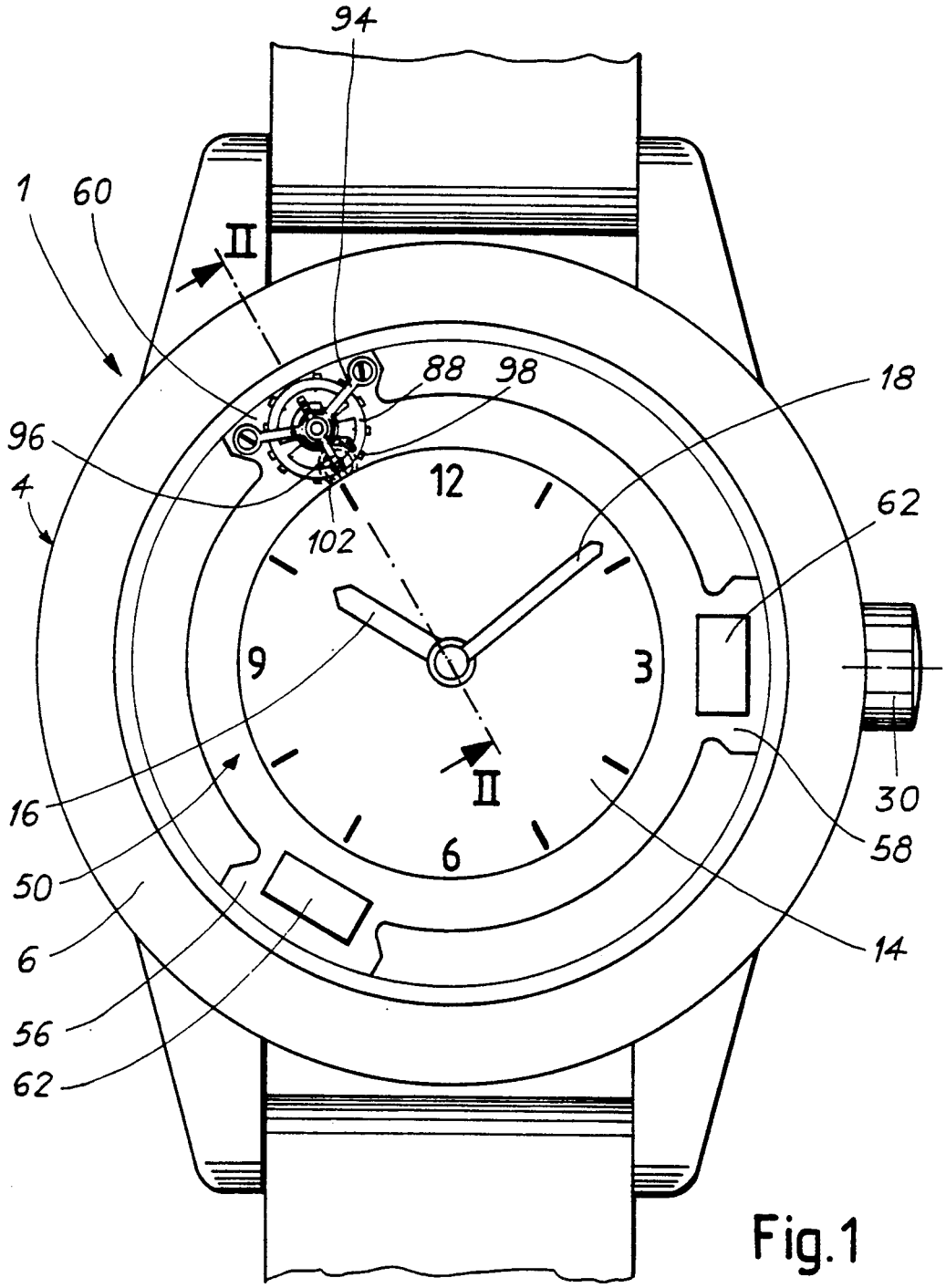
FIG. 1 is a top view of an embodiment of a wristwatch equipped with a timepiece movement according to the invention.
Figure 2:
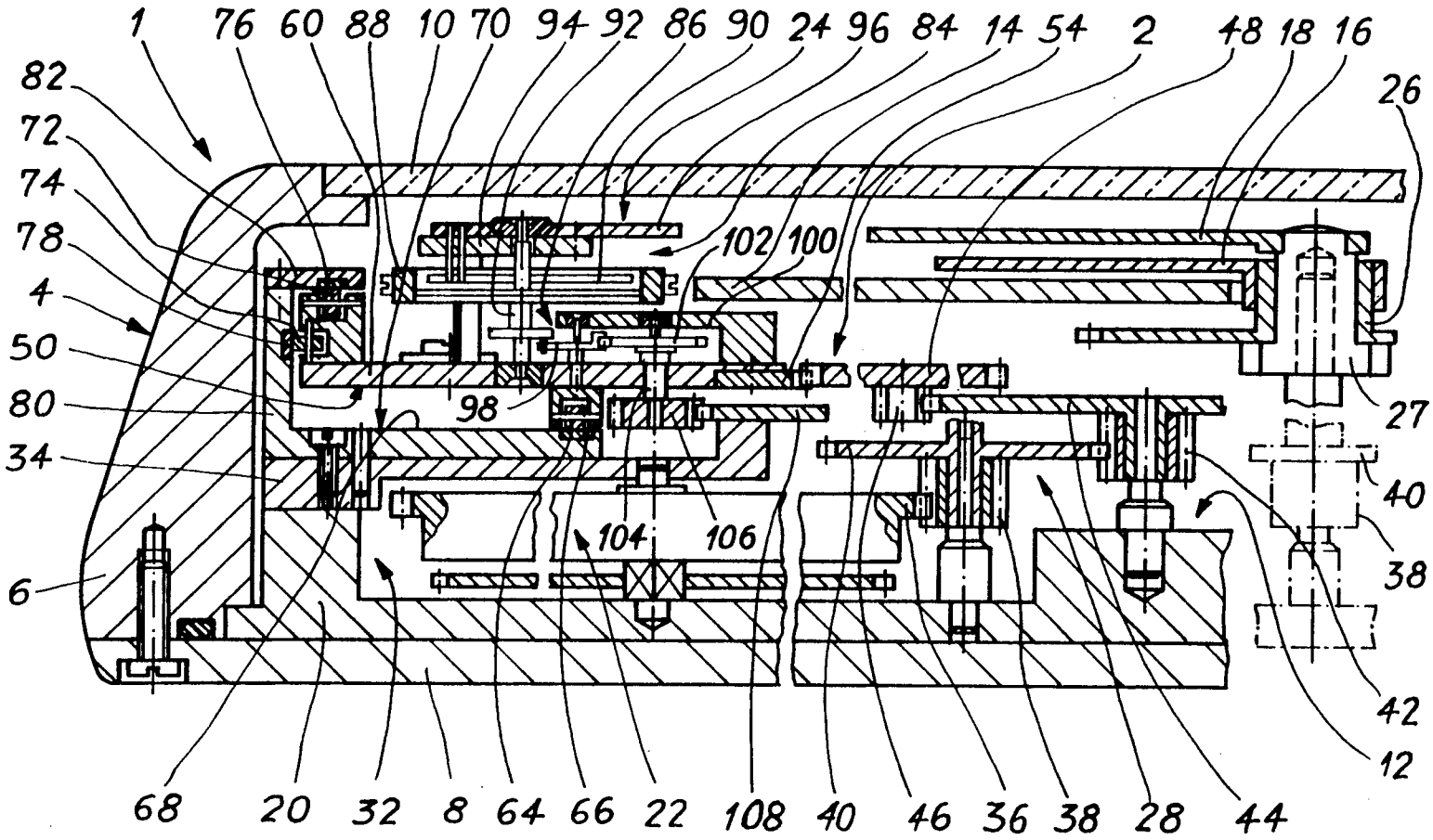
FIG. 2 is a partial cross-section of a wristwatch along line II—II of FIG. 1 showing the manner of assembling and driving the support element.

Referring initially to FIGS. 1 and 2, there is seen a timepiece, here a wristwatch, designated by the general reference 1, and equipped with a timepiece movement 2 according to the invention. While retaining similar dimensions, such timepiece could be a pocket watch or a pendant watch.

Such timepiece comprises a case 4 exhibiting, in a known manner, a caseband 6 closed by a back cover 8 and by a crystal 10 in order to define a housing 12. The movement 2, housed in housing 12, is surmounted by a dial 14 and two indicating elements, respectively for hours 16 and minutes 18.

The movement 2 comprises in a standard manner a baseplate 20 on which are mounted motor means 22, an oscillating system 24 and driving means 26, 27 for the indicating parts 16 and 18 formed respectively by the hours pipe and the cannon pinion. Furthermore, the movement comprises a gear train 28 coupling the motor means 22 to the driving means 26, 27 and of which only the wheels and pinions necessary for understanding the invention have been shown. The movement also comprises a standard winding and time setting system of which only a crown 30 is shown.

In the embodiment shown, the motor means 22 are formed by a spring (not shown) and enclosed in a barrel. Such barrel is housed in a cavity 32 provided in the baseplate 20 and is mounted between the bottom of such cavity 32 and a barrel bridge 34. Such barrel comprises a drive wheel 36 which forms a first wheel of the gear train 28. Such wheel 36 is in mesh with a center pinion 38 which itself bears a center wheel 40. The center wheel 40 which furthermore bears indirectly the minutes indicating element 18, meshes with a reduction pinion 42. This latter bears a reduction wheel 44 which meshes with an entry pinion 46. Such pinion 46 also bears an entry wheel 48 meshing indirectly with the oscillating system 24 which is to be described in greater detail hereinafter.

It will be noted that all these pinions and wheels are pivoted in a known manner between stones provided respectively in recesses in the baseplate and bridges (not shown).

According to the invention, the movement furthermore comprises a support element 50 intended to support at least one element making up the movement. In the described embodiment, the element making up the movement, which is borne by the support element 50, is the oscillating system 24. Such support element 50 has a generally planar form and shows a cavity 52 in its central portion. The support element 50 is mounted substantially at the surface of the baseplate and is driven in rotation in the vicinity of the edge of this latter by the entry wheel 48 which meshes with interior teeth 54 provided on the edge of the cavity 52.

Figure 3:
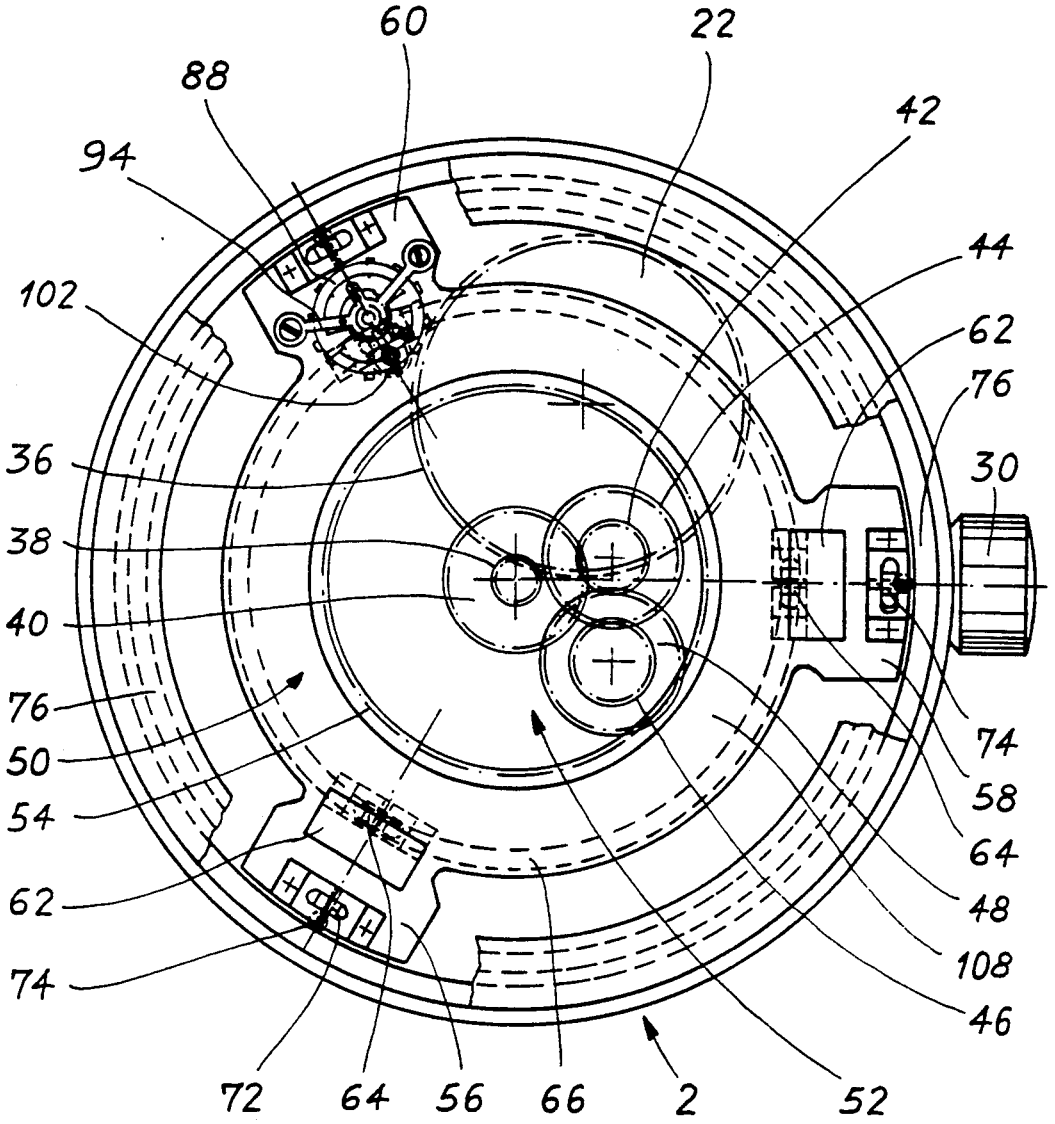
FIG. 3 is a top view, partially stripped, of an embodiment of the timepiece movement according to the invention, the dials and hands having been omitted.

As is clearly seen from FIGS. 1 and 3, such support element 50 has the form of a star comprising three branches 56, 58, 60 extending at 120° relative to one another and one 60 of which bears the oscillating system 24. The other two preferably bear compensating masses 62. Such compensating masses are selected and arranged in order to balance the oscillating system and may for instance take the form of decorative objects.

As is well understood, the support element may assume any other form as long as it maintains a generally planar form. According to one variant, one could provide the use of a support element having the form of a simple ring, or yet of a star comprising any number of branches. It is self-evident that whatever be the form of the support element 50, this latter will be balanced by means of compensating masses chosen and arranged in an appropriate fashion.

Referring now more particularly to FIGS. 2 and 3, it is seen that each branch of the support element 50 rests on the baseplate 20 through a roller 64 which runs on a circular track 66 extending entirely over a diameter of the baseplate. This track 66 is formed by a polished ring of hard material, for example tempered steel, inset in the base 68 of a circular cup-formed part 70 hollowed out in its center. Such cup is fixed to the baseplate. Each branch also comprises two other rollers 72, 74 respectively running on roller tracks 76, 78 inset in the interior wall 80 of the cup 70 and a flange 82 extending perpendicular to the wall and towards the interior of the cup. The rollers 64 and 72 bring about the axial guiding of the support element 50 at the surface of the baseplate and the rollers 74 bring about radial guidance.

It is self-evident that such rollers may be replaced by other guide means and by way of example the person skilled in the art could provide the use of ball-bearings or the like.

The oscillating system comprises essentially a regulator 84 and an escapement 86. The regulator 84 comprises in a standard manner a balance wheel 88, a balance spring 90 mounted on a balance staff 92 which is pivoted between two stones, respectively provided in the upper surface of the branch 60 and in a bridge 94 secured onto such branch. Bridge 94 also bears an index 96 provided with index pins.

It will be noted that the balance wheel extends substantially in the plane of dial 14 so that it is at a small distance from the crystal and better visible through the latter.

Furthermore, an anchor 98 pivoted between branch 60 and a bridge 100 secured to this latter cooperates on the one hand with the balance staff 92 and on the other hand with an escapement wheel 102. The escapement wheel 102 is borne by an axis 104 also pivoted between branch 60 and bridge 100. Such axis 104 also bears an escapement pinion 106, this latter and the escapement wheel extending on either side of the plane of branch 60 in a manner such that wheel 102 is found above branch 60, that is to say, in the direction of the side of crystal 10 and pinion 106 is located below branch 60, that is to say in the direction of the side of baseplate 20. The pinion 106 meshes with a toothed ring 108 fixed to the baseplate.

Thus, in contrast to traditional movements in which the entry wheel generally called seconds wheel meshes directly with the escapement pinion, the entry wheel 48 meshes, in accordance with the invention, with teeth 54 in order to drive the support element 50 in rotation around the center of the movement. This rotation of the support element 50 enables the escapement pinion 106 to roll on the toothed ring 108 and thus to provide the necessary force to the balance wheel through the escapement wheel 102 and anchor 98 in order that it may oscillate.

In providing the gear train 28 and toothing 54 with an appropriate number of teeth, the support element 50 bearing the oscillating system 22 may be animated with rotational movement around the chapter ring of the watch at a rate of one revolution per minute so that, in addition to the attractive decorative effect given by the mobility of the oscillating system around the dial, such support element advantageously indicates seconds.

In the embodiment which has just been described, the timepiece comprises a single barrel, but it is well understood that it may comprise two if such would appear necessary, for example if the energy provided by a single barrel is insufficient to drive the support element equipped with the oscillating system and the compensating masses.

As is well understood, the invention is not limited to the embodiment which has just been described and one may provide for example the use of this same concept with an electro-mechanical timepiece movement. In such embodiment the rotor of an electric motor may be pivoted in one branch of the support element 50, such same branch forming the stator of the motor and bearing the windings, while the other two branches of the support element bear respectively the power cell and the circuit providing the time base. Connection tracks between the different elements borne by the support element may be formed on this latter in a manner such that the entire electrical part of the movement is borne on the mobile portion of the system. In such case, the axis of the rotor furthermore bears a wheel which meshes with a toothed crown fixed to the baseplate, while the interior teeth of the support element drive a wheel pivoted on the baseplate which wheel drives in turn a gear train coupled to the driving elements for the indicators.

It will be noted furthermore that the support element 50 and the bottom of the cup 70 of the movement described hereinabove exhibit in an advantageous manner smooth visible surfaces which may be easily decorated. One may for instance engrave them, enchase them or indeed provide them with precious stones by setting.

What is claimed is:

1. A timepiece movement comprising baseplate means, motor means, an indicator for indicating time, driving means for driving the indicator, gear train means comprising at least one wheel coupling the driving means to the motor means, oscillating means for regulating the motion of the gear train means, and a support element for supporting at least one of said means constituting the movement other than the baseplate means, said support element being driven in rotation in the vicinity of the edge of the baseplate means by a wheel of the gear train means.

2. A timepiece movement as set forth in claim 1 wherein the movement is a mechanical movement in which the support element bears the oscillating means, such latter comprising a regulating member and an escapement.

3. A timepiece movement as set forth in claim 1 wherein the support element has a generally planar form and comprises a central cavity provided on its edge with teeth by which the support element is driven.

4. A timepiece movement as set forth in claim 2 wherein the escapement comprises an escapement pinion which rolls on teeth which are at least indirectly united with the baseplate means.

5. A timepiece movement as set forth in claim 3 wherein the support element has the general form of a star, one of the branches of which bears the oscillating means.

6. A timepiece movement as set forth in claim 5 wherein the branches not bearing the oscillating means bear compensating masses.

7. A timepiece movement as set forth in claim 1 further comprising guiding means for the support element on the baseplate means.

8. A timepiece movement as set forth in claim 7 wherein the guiding means comprises rollers mounted for rotation on the support element, the rollers running on circular guide tracks provided on the baseplate means.

9. A timepiece movement as set forth in claim 8 wherein the guide tracks comprise a ring of hard material inset into the baseplate means.

10. A timepiece movement as set forth in claim 2 wherein the regulating member comprises a balance spring and a balance wheel and is mounted for rotation between two pivots respectively provided on a branch of the support element and on a bridge extending from such branch.

11. A timepiece movement as set forth in claim 10 in which the escapement is provided with an anchor, a wheel and a pinion, and wherein the escapement anchor, the escapement wheel and the escapement pinion are pivoted on a branch of the support element bearing the oscillating means.

12. A timepiece movement as set forth in claim 11 wherein the branch has a generally planar form, and the escapement wheel and the escapement pinion extend on either side of the plane of the branch.

13. A timepiece comprising a movement and a case provided with a crystal so as to define a housing in which is housed the movement, said movement comprising baseplate means, motor means, an indicator for indicating time, driving means for driving the indicator, gear train means comprising at least one wheel coupling the driving means to the motor means, oscillating means for regulating the motion of the gear train means, and a support element for supporting at least one of said means constituting the movement other than the baseplate means, said support element being driven in rotation in the vicinity of the edge of the baseplate means by a wheel of the gear train means, and said movement being surmounted by a dial and at least one indicating element of said indicator.

14. A timepiece as set forth in claim 13 wherein the dial extends substantially above and beyond a central cavity of the support element.

* * * * *